United States Patent [19]

Gagliardo et al.

[11] Patent Number: 4,535,846

[45] Date of Patent: Aug. 20, 1985

[54] FIRE FIGHTING TURRET

[75] Inventors: John P. Gagliardo, Shrewsbury; Donald K. Morse; Albert Pruneau, Jr., both of Worcester, all of Mass.

[73] Assignee: Feecon Corporation, Westboro, Mass.

[21] Appl. No.: 529,329

[22] Filed: Sep. 6, 1983

[51] Int. Cl.[3] ..... A62C 31/02; B05B 13/04

[52] U.S. Cl. ..... 169/25; 239/507

[58] Field of Search ..... 169/25; 239/587

[56] References Cited

U.S. PATENT DOCUMENTS

| | | | |
|---|---|---|---|
| 2,698,664 | 1/1955 | Freedman | 169/25 |
| 2,729,295 | 1/1956 | Edwards | 169/25 |
| 2,729,296 | 1/1956 | Gurney | 169/25 |
| 2,753,003 | 7/1956 | Gurney et al. | 169/25 |
| 3,010,519 | 11/1961 | Gillespie | 169/25 |
| 4,156,503 | 5/1979 | Norén | 239/587 X |

*Primary Examiner*—Andres Kashnikow

*Attorney, Agent, or Firm*—Blodgett & Blodgett

[57] ABSTRACT

Turret for moving a fire fighting nozzle in an oscillation mode and in an elevation selecting movement. The turret having a separate controllable double-acting pneumatic cylinder for each movement, operated by pressured air.

7 Claims, 9 Drawing Figures

48
5
4
11
10
1
12
RELAY
44
39
OPEN & CLOSE
TOGGLE SWITCH
43
D
R
L
E
43
OSC
JOY
1
1
4
5
6
67
7
8
9
TERMINAL STRIP
ROTATION LEFT
LIMIT SWITCH N.O.
46
GRN
YEL
47
BL
GRN
ROTATION RIGHT
LIMIT SWITCH N.C.

FIRE FIGHTING TURRET

BACKGROUND OF THE INVENTION

In the design and manufacture of fire fighting turrets, particularly those intended to be mounted on vehicles, it has been common practice to use hydraulic actuators for producing adjustment of the nozzle in a vertical angular mode, as well as for oscillatory horizontal swinging movement. While a hydraulic system is adequate under many circumstances, it is also expensive, since a typical fire-fighting vehicle on which the turret is to be mounted does not have a pressure oil supply system. Such vehicles usually, however, have a pressure air system, but producing these movements of the turrets by pressure air has always been a problem, because of the expense involved and because of the delicate nature of air controls. Among other things, it has been difficult to arrange a system in which the speed of the horizontal swinging action of the nozzle can be adjusted. These and other difficulties experienced with the prior art apparatus have been obviated in a novel manner by the present invention.

It is, therefore, an outstanding object of the invention to provide a fire fighting turret in which the arc of the oscillatory movement of the nozzle can be adjusted and the direction of area of the swing can also easily be adjusted.

Another object of this invention is the provision of a turret including a fire fighting nozzle operated in the elevation and rotation modes by air pressure.

A further object of the present invention is the provision of a fire fighting turret which is simple in construction, which is inexpensive to manufacture, and which is capable of a long life of useful service with a minimum of maintenance.

Another object of the invention is the provision of a fire fighting turret in which all of the controls can be manipulated from an enclosure on the exterior of which the turret is mounted.

With these and other objects in view, as will be apparent to those skilled in the art, the invention resides in the combination of parts set forth in the specification and covered by the claims appended hereto.

SUMMARY OF THE INVENTION

In general, the present invention consists of a fire fighting turret having a nozzle which includes a main body adapted to receive fluid under pressure, an intermediate body mounted on the main body for swinging motion about a vertical axis, and a nozzle mounted on the intermediate body for vertical movement about a horizontal axis. A control rod extends through the main body and the intermediate body is mounted therein for sliding movement. The rod is connected at its upper end to the nozzle for bringing about the said movement about a horizontal axis. An elevation cylinder is mounted in fixed relationship to the main body and serves to move an actuating element which is provided with a verticallyinclined slot. A guide element rides in the slot, while the elements join a movable element of the cylinder to the control rod to bring about vertical movement of the rod when the cylinder is energized.

More specifically, the elevation cylinder and a rotation cylinder are double acting. A source of high pressure air is connected to each end of the elevation cylinder through a solenoid-operated 3-way valve, so that one end at a time can be exhausted by its valve to produce piston movement. The source of high pressure air is also connected to each end of the rotation cylinder source of high pressure air is also connected to each end of the rotation cylinder through a solenoid-operated three-way valve and through a variable pressure regulator to the exhaust parts in the solenoid-operated 3-way valves, which, when operated, supplies a somewhat lower air pressure into one end of the rotation cylinder. This provides piston movement by differential pressure on opposite sides of the piston. Piston speed may be varied by altering the setting of the variable pressure regulator.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
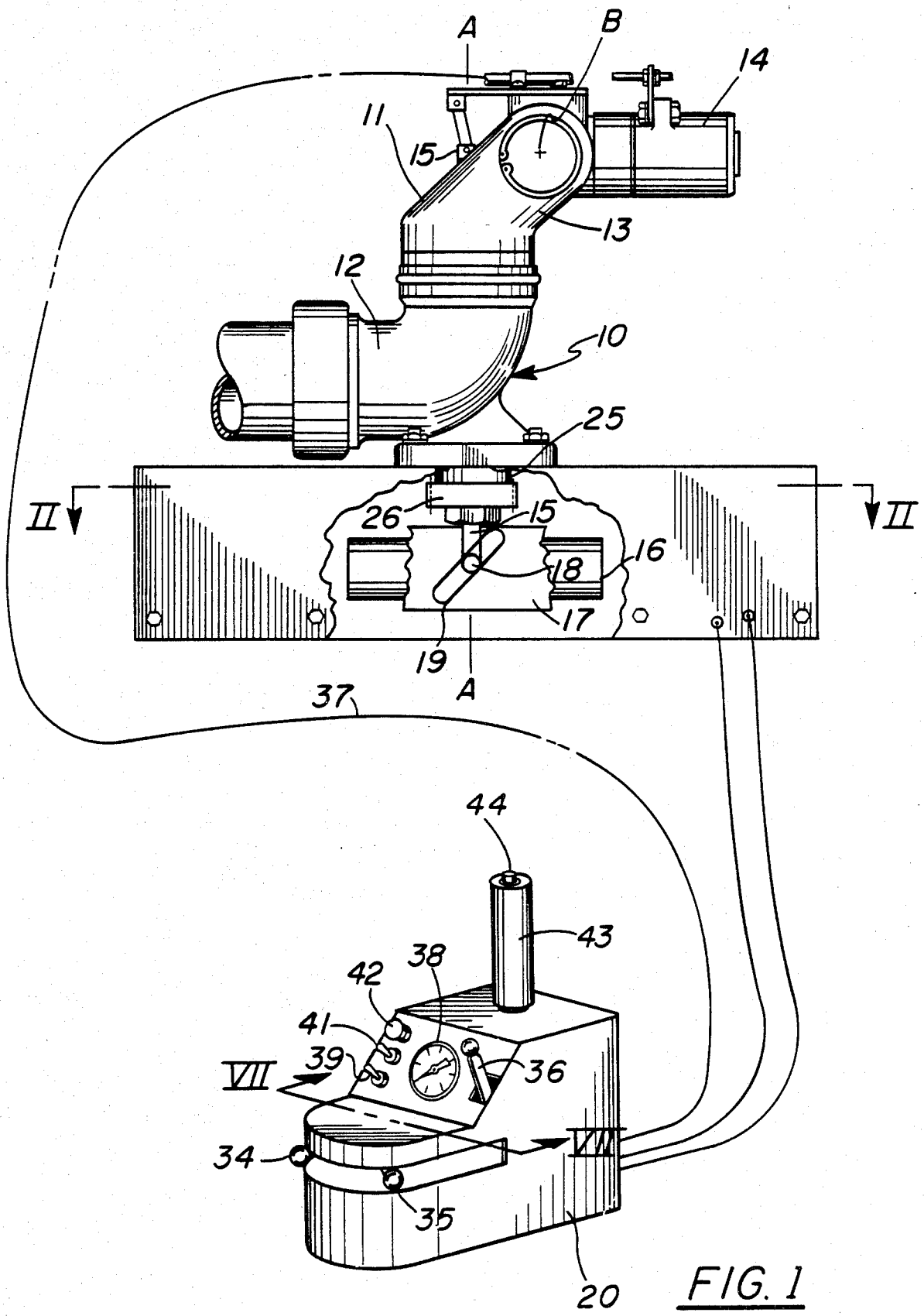
FIG. 1 is a perspective view of a fire fighting turret incorporating the principles of the present invention.

Referring first to FIG. 1, which best shows the general features of the invention, the fire fighting turret, indicated generally by the reference numeral 10, is shown as consisting of a nozzle apparatus 11 and a control box 20. The nozzle apparatus includes a main body 12 adapted to receive fluid under pressure, an intermediate body 13 mounted on the main body for swinging motion about a vertical axis A—A, and a nozzle 14 mounted on the intermediate body for movement about a horizontal axis B—B. A control rod 15 extends through the main body 12 and the intermediate body 13 and is mounted within them for vertical sliding movement; the rod is connected at its upper end to the nozzle 14 for bringing about the swinging movement about the horizontal axis B—B. An elevation cylinder 16 is mounted in fixed relationship to the main body and an actuating element 17 is provided between the movable element of the cylinder 16 and the control rod 15 to bring about vertical movement of the rod when the cylinder 16 is energized. The actuating element 17 is provided with an inclined slot 19, a fixed vertical slot parallel to the rod 15, and a guide element 18 riding in the slots.

The elevation cylinder 16 has a tubular body that is fixedly mounted at a right angle to the rod 15 and is provided with a piston (not shown) having a piston rod 21 which extends from both ends of the body. The actuating element 17 consists of an elongated plate in which the inclined slot 19 is formed, the ends of the plate being attached to the piston rod 21 for movement in synchronization with the piston. The guide element 18, which rides in the slot, consists of a roller mounted on the lower end of the control rod 15.

Figure 2:
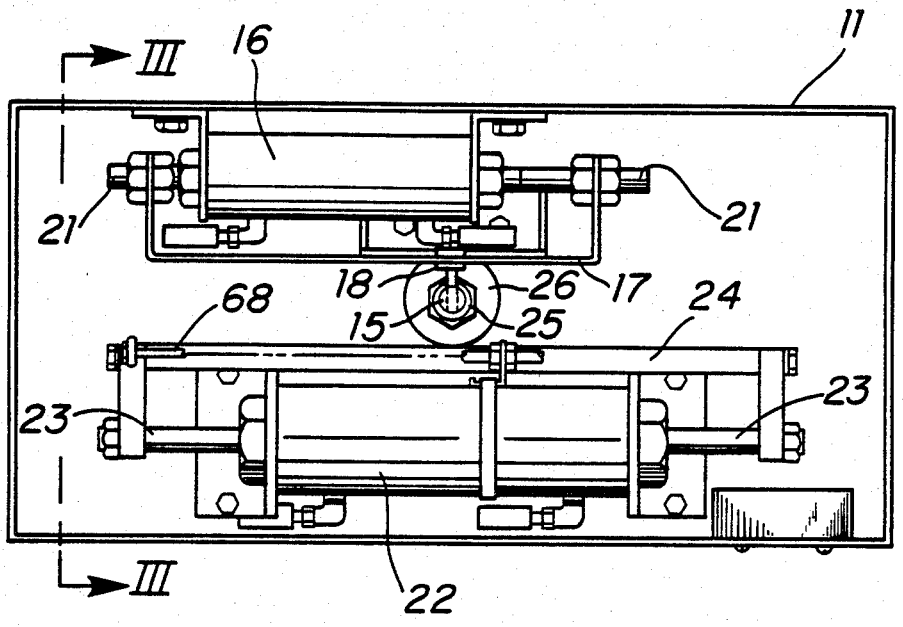
FIG. 2 is a sectional view of the turret taken on the line II—II of FIG. 1.
Figure 3:
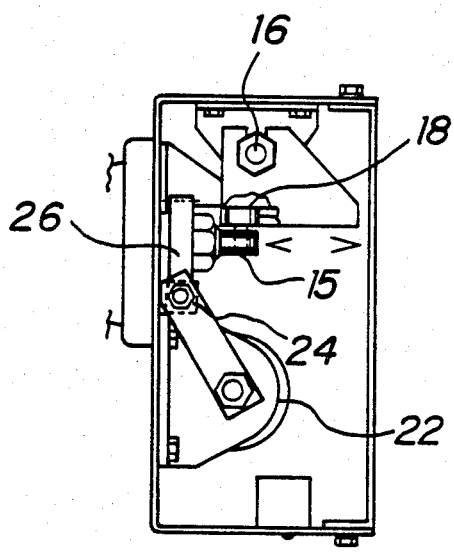
FIG. 3 is a vertical sectional view of the turret taken on the line III—III of FIG. 2.

A rotation cylinder 22 is also mounted under the main body 12 of the nozzle apparatus in an enclosure and has a piston (not shown) with a piston rod 23 extending from both ends of the body, as is evident in FIG. 2. A rack 24 extends horizontally along the cylinder with each end connected to an adjacent end of the piston rod 23. A tube 25 extends around the control rod, has its upper end fixed to the intermediate body 13, and has a gear 26 mounted on its lower end for engagement with the rack 24 to produce the swinging motion of the intermediate body and the nozzle.

Figure 4:
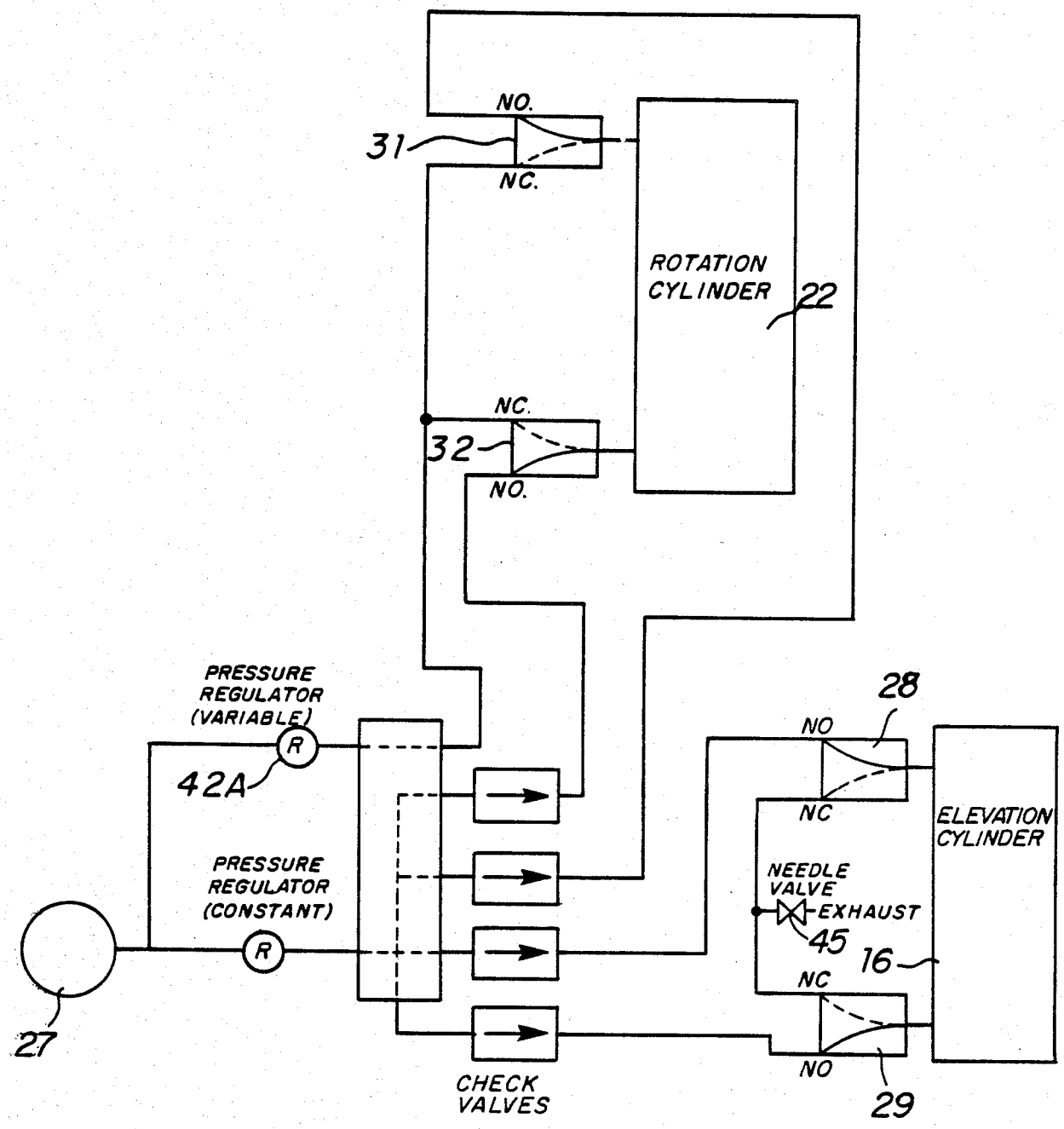
FIG. 4 is a schematic view of the pneumatic connections controlling the turret.

Referring next to FIG. 4, it can be seen that the elevation cylinder 16 and the rotation cylinder 22 are double-acting and are connected to a source 27 of high pressure air. This air is connected to each end of the elevation cylinder through identical valves, these being the solenoid actuated three-way valves 28 and 29 connected to the ends. The energization of one of the three-way valves allows the air at its particular end of the cylinder 16 to be exhausted to piston movement toward the end. The source of high pressure air 27 is also connected through solenoid-operated 3-way valves 31 and 32 to each end of the rotation cylinder 22. The exhaust side of each of the solenoid-actuated valves is connected to the downstream side of a self-relieving pressure regulator 42A. Actuation of either one of the 3-way valves will terminate the high-pressure air supply to the corresponding side of the rotation cylinder 22 and connects a lower pressure supply through the self-relieving regulator to produce piston movement by differential pressure on opposite sides of the piston.

Figure 9:
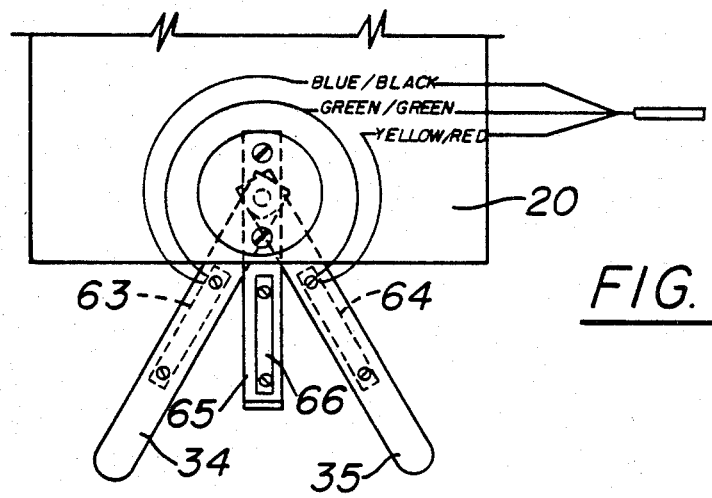
FIG. 9 is a plan of a portion of the control box taken on the line IX—IX of FIG. 7.
Figure 7:
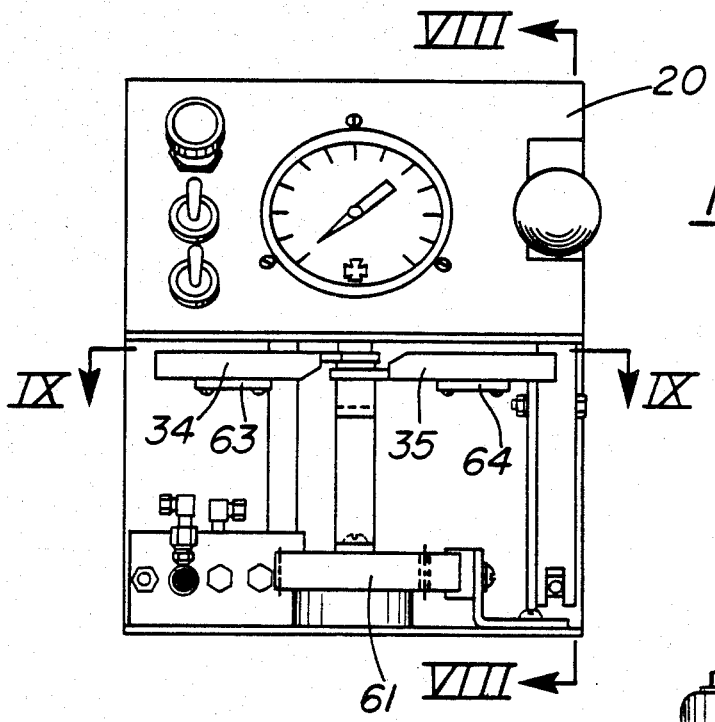
FIG. 7 is a vertical sectional view of a control box portion of the turret taken on line VII—VII of FIG. 1.
Figure 8:
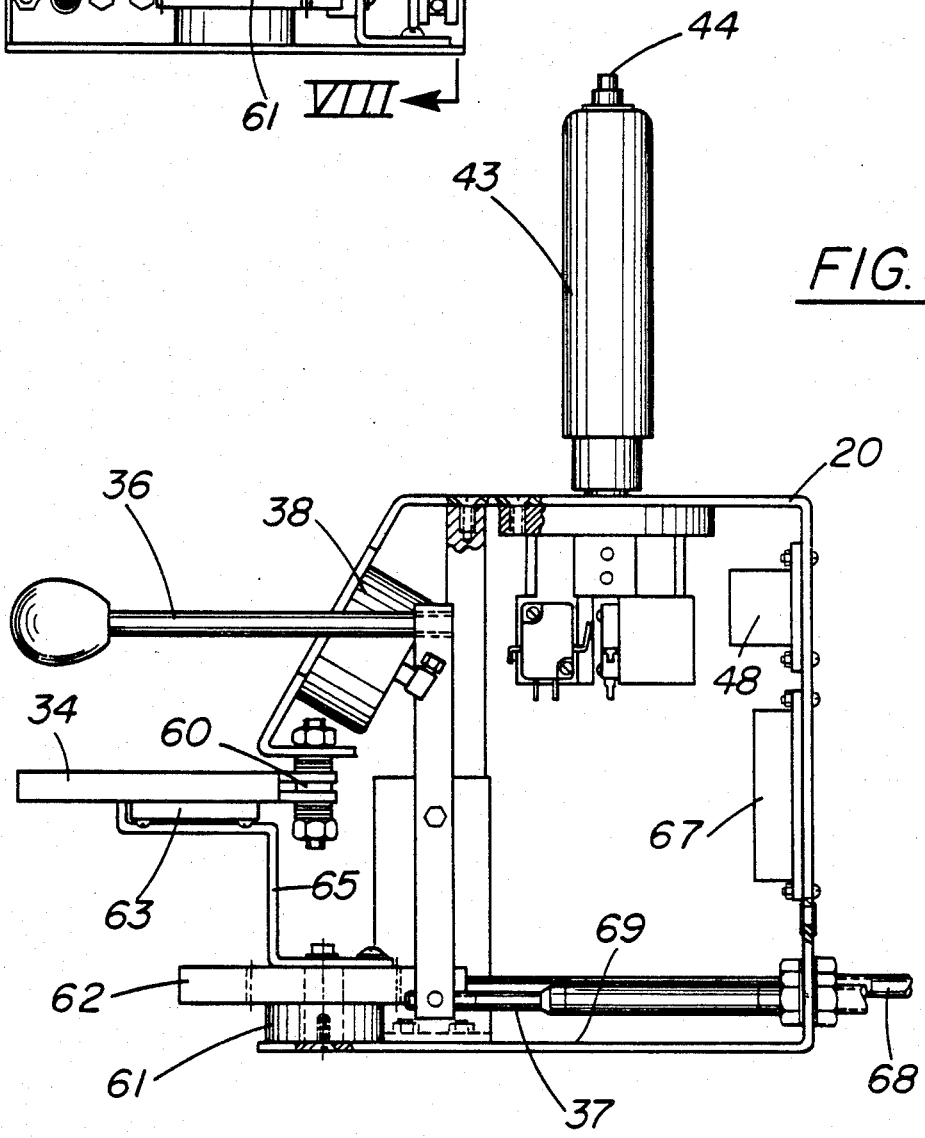
FIG. 8 is a vertical sectional view of the control box taken on the line VIII—VIII of FIG. 7.

Referring to FIGS. 7, 8, and 9, can be seen that oscillation control is provided in the control box 20. This oscillation control is provided to permit adjustment not only of the angle or arc of swinging motion of the intermediate body 13 and the nozzle 14, but also the location of the swinging motion, i.e., the direction of the bisector of the angle. Two fingers 34 and 35 are provided to bring about the selection of these two variables. The two fingers are movable in a horizontal plane about a common axis and the angle between the fingers determines the arc of the swinging motion, while the location of the fingers determines the location of the swinging motion in general.

Referring again to FIG. 1, it can be seen that a spray-pattern control handle 36 is located on the control box 20 and operates a cable 37. This cable passes to the nozzle 14 and serves to select the setting of the nozzle which is capable of being adjusted from a straight flow stream to a fan or wedge-shaped flow in accordance with the teachings of the patent application of John Gagliardo, Ser. No. 419,456, filed Sept. 17, 1982, now abandoned.

The arc of oscillation in the horizontal plane of the nozzle 14 is, as has been discussed above, adjustable in two respects by use of the fingers 34 and 35. A gage 38 indicates the pressure of the air originating in the source 27, which source, incidently, is normally part of a fire fighting vehicle. An automatic oscillation on-off switch 39 is mounted on the control box 20 as well as a discharge switch 41. An oscillation speed control knob 42 (which is the self-relieving regulating 42A discussed previously) is mounted on the box and a joy stick 43 (for normal aiming of the nozzle when not in automatic oscillating mode) extends upwardly with a discharge switch 44 mounted in its upper end for operation by the operators thumb.

Referring to FIG. 4, it can be seen that a needle valve 45 is located in the return line or exhaust line from the solenoid valves 28 and 29 that are associated with the elevation cylinder 16. The return line from the rotation cylinder valves 31 and 32 contains instead the self-relieving regulator 42A.

Figure 5:
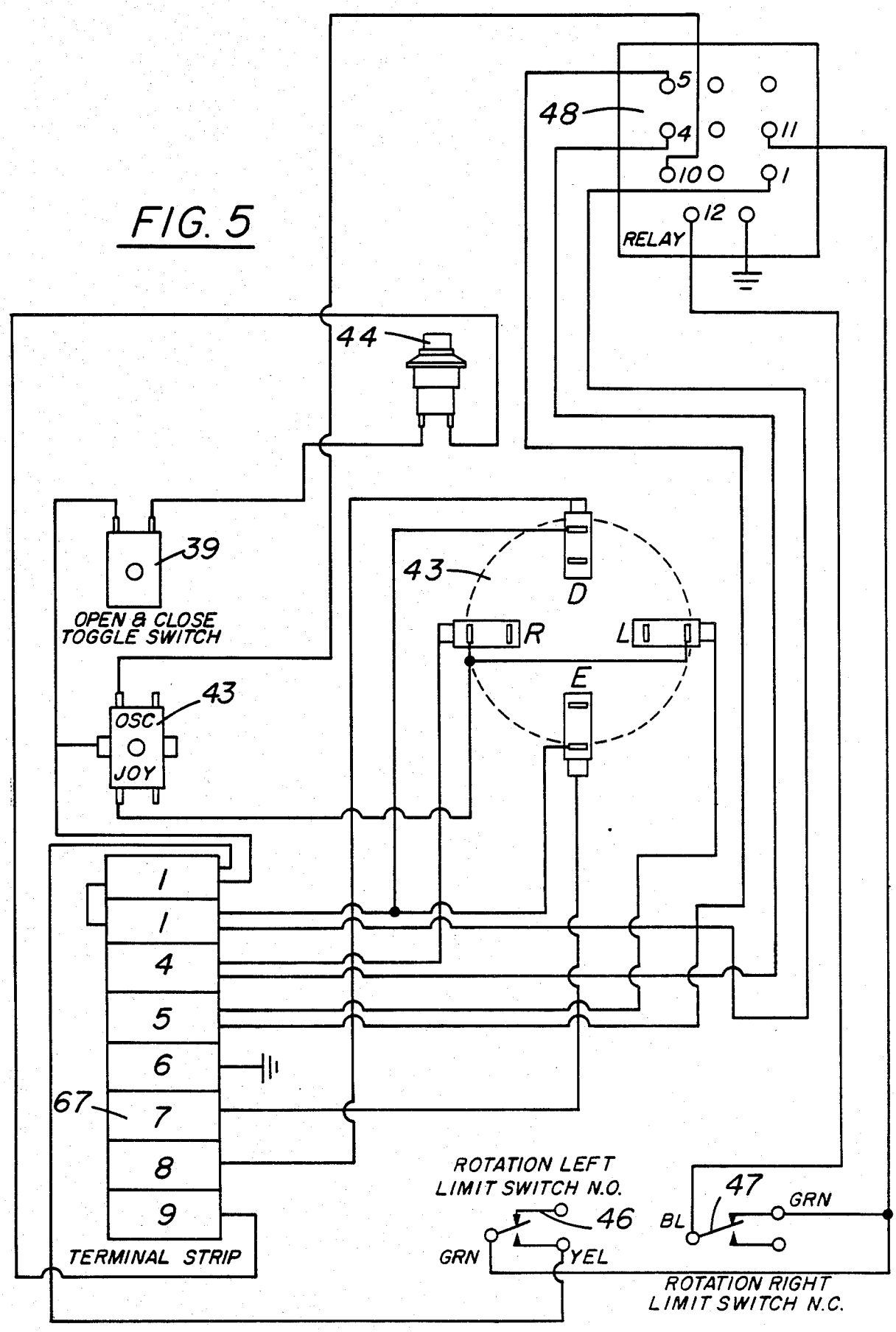
FIG. 5 is an electrical schematic of the equipment used in the turret.

FIG. 5 shows some of the details of the electrical circuitry, including the circuitry associated with the joy stick 43, the toggle switch 39, switch 44, and the contacts associated with the joy stick 43. The circuit shows the rotation left limit switch 46 and the rotation right limit switch 47 connected to a relay 48.

Figure 6:
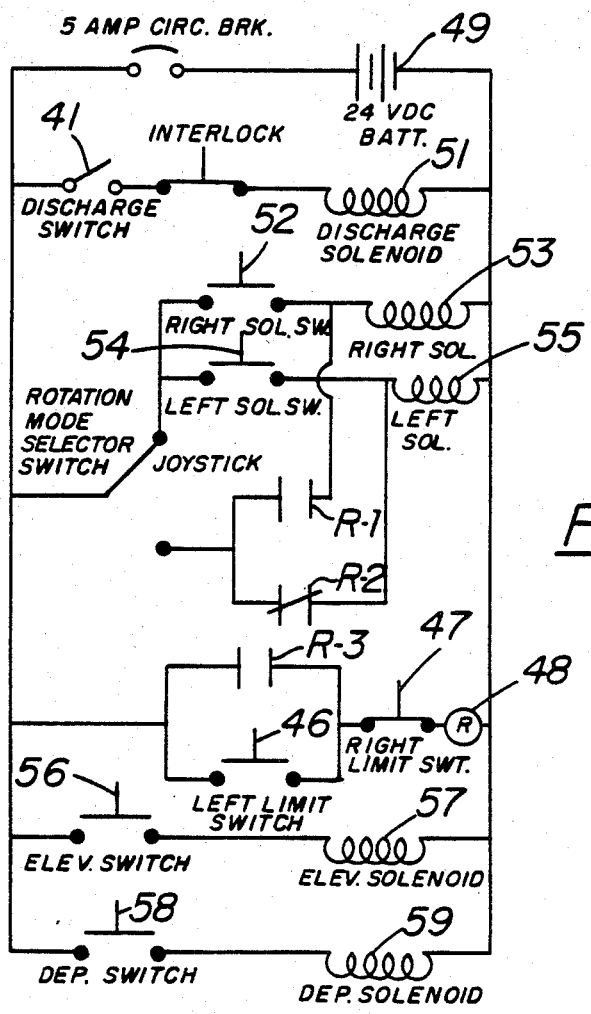
FIG. 6 is an electrical schematic of the important elements in the electrical circuitry of the turret.

Referring next to FIG. 6 which shows further elements of the electrical circuitry, it can be seen that a battery 49 is provided to operate the various elements which control the turret. The discharge switch 41 causes current to pass through the coil 51 to actuate a 4-way valve which controls a cylinder connected to the turret discharge valve, causing the fire-fighting agent to flow through the turret and out of the nozzle. Switch 52 is used to energize a coil 53 of a right solenoid and a switch 54 is to energize the coil 55 of a left solenoid. Coils 53 and 55 can be energized by contacts R-1 and R-2, respectively, of a relay 48 limit switch 47 in series with the coil of the relay 48. The left limit switch 46 is mounted in parallel with a normally-open contact R-3 of the relay 48. The switch 56 operates the coil 57 of an elevation solenoid, while a depression switch 58 energizes the coil 59 of a depression solenoid 59. In the relay 48, the contacts R-1 are normally-open, the contacts R-2 are normally-closed, and the contacts R-3 are normally-open.

FIGS. 7, 8, and 9 show the inner construction of the control box 20, particularly the manner in which the fingers 34 and 35 are mounted on a common pivot 60. The handle 36 can be manipulated to move the cable 37 which operates the spray pattern selection. The joy stick 43 extends above the top of the control box and the switch 44 is mounted on top of the joy stick. On the bottom of the control box with its pivot in alignment with the pivot 60 is a gear 61 which engages a rack 12. Under the finger 34 is a reed switch 63, under the finger 35 is a similar reed switch 64. Extending upwardly from the gear 61 is a bracket 65 on which is mounted a magnet 66. The terminal strip 67 is located at the back of the box and, of course, appears also in the electrical schematic shown in FIG. 5. The contacts associated with the joy stick 43 are also shown in FIG. 5. The relay 48 is also located on the rear wall. A cable 68 is connected to the rack 62 and serves to rotate the gear 61 and to swing the bracket 65 with its magnet 66 from side to side. This actuates the reed switches 63 or 64 as the cable, as is evident in FIG. 2, swings back and forth with the rack 24 associated with the rotation cylinder 22.

The operation and advantages of the present invention will now be readily understood in view of the above discussion. In FIG. 1, it can be seen that the turret 10 consists of a control box 20 and the nozzle apparatus 11 which operates under the manipulation of the control box elements. The elevation cylinder 16, of course, serves to tilt the nozzle 14 in a vertical plane about the pivot B—B, while the rotation cylinder 22 serves to swing the nozzle 14 and the intermediate body 13 about the axis A—A. In this way, the stream of fluid connected to the main body 12 is directed not only at a suitable vertical angle, but also in a swinging motion above or below a horizontal direction. Normally, the elevation of the nozzle 14 will be selected and then left in a given position. In the same way, by manipulating the handle 36, the type of pattern can be selected within the nozzle in accordance with the above discussion. In order to cause the nozzle 14 to swing about the pivot A—A, the fingers 34 and 35 are set wherever the desired pattern needs to be. The angle between the fingers determines the angle of swing, while the way that they are related to the center of the bracket 69 determines where the arc will take place from side-to-side. As the nozzle and the intermediate body 13 are swung through the selected angle and pointed in the selected direction, the cylinder 22 which causes this action is operating the rack 24 which brings about the movement because of the engagement of the rack with the gear 26. At the same time that the rack 24 is moving back and forth in the selected range, it carries the cable 68 with it. This cable operates the rack 62 which manipulates the gear 61 and causes the bracket 65 to swing through a similar arc. When the bracket carries the magnet 66 under the reed switch 63, the switch closes and causes a reversal of direction of the rotation cylinder. In a similar way, when the bracket moves to the right (in FIG. 9) and the magnet 66 comes under the reed switch 64, the movement is reversed again. The switches 63 and 64 operate the relay 48 which, in turn, reverses the direction of the nozzle. Adjustment of the elevation cylinder takes place by operation of the particular 3-way valve that is necessary to do so. The 3-way valve at the end of the piston toward which the piston is to be moved is actuated to exhaust air from that side of the piston, so positive pressure appears only on one side of the piston and brings about movement. In a similar way, the rotation cylinder 22 is operated in one direction by energizing the solenoid valve 31 and connecting it to the pressure regulator, so that the regulator 42A maintains slightly lower pressure on that side of the piston, so that movement takes place in at a desired speed. The lower pressure is selected by the adjusting knob 42 which is associated with the regulator 42A.

It can be seen, then, that complete control of the turret can take place within the cab of the vehicle with the operator completely sheltered from the elements, from the fire, and from the fluid leaving the nozzle. The control can take place manually by use of the joy stick 43 and oscillation can take place automatically by setting the fingers 34 and 35 in a suitable position. The apparatus makes use of the air supplied as part of the vehicle and there are no problems with hydraulic fluid leaking or anything of that kind. The rate of oscillation is, of course adjustable, as well as the angle through which the nozzle swings and the direction in which the swinging through that angle takes place. The adjustments are very easy to make from the operator's position in front of the control box. There is of course a selection between the oscillation mode of operation and the manual operation by means of the joy stick 43, this selection taking place by operation of the switch 39.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Fire fighting turret, comprising:

(a) a nozzle apparatus, including a main body adapted to receive fluid under pressure, an intermediate body mounted on the main body for swinging motion about a vertical axis, and a nozzle mounted on the intermediate body for movement about a horizontal axis, (b) a control rod extending through the main body and the intermediate body, mounted therein for vertical sliding movement, and connected at its upper end to the nozzle for bringing about the said movement about a horizontal axis, (c) an elevation cylinder mounted in fixed relationship to the main body, and (d) an actuating element with an inclined slot, a vertical slot, and a guide element riding in the slots, the elements joining a movable element of the cylinder and the control rod to bring about vertical movement of the rod when the cylinder is energized.

2. Fire fighting turret as recited in claim 1, wherein the elevation cylinder is pneumatic and has a body that is fixedly mounted at a right angle to the control rod and a piston having two piston rods, one of which extends from each end of the body, the actuating element consisting of an elongated plate in which the inclined slot is formed and whose ends are attached to the piston rods for movement in synchronization with the piston, and wherein the guide element consists of a roller mounted on the lower end of the rod for sliding movement in the inclined slot as well as the vertical slot.

3. Fire fighting turret as recited in claim 2, wherein the rotation pneumatic cylinder is mounted under the main body, the cylinder having a piston with a piston rod extending from both ends of the body, wherein a rack is horizontally mounted with each end connected to a piston rod, and wherein a tube surrounds the control rod, has its upper end fixed to the intermediate body, and has a gear mounted on its lower end for engagement with the rack to produce the swinging motion of the intermediate body and the nozzle.

4. Fire fighting turret as recited in claim 3, wherein the elevation cylinder and the rotation cylinder are double-acting, wherein a source of high pressure air is connected to each end of the elevation cylinder through a solenoid-operated 3-way valve, so that one end at a time can be exhausted by its valve to produce piston movement, and wherein the source of high pressure air is connected through solenoid-operated 3-way valves to each end of the rotation cylinder and through a self-relieving regulator to the exhaust parts of the 3-way valves to produce piston movement by differential pressure on opposite sides of the piston.

5. Fire fighting turret as recited in claim 4, wherein an oscillation control is provided to permit adjustment not only of the arc of swinging motion but also the location of the swinging motion, the oscillation control being provided with two fingers movable in a horizontal plane about a common axis, the angle between the fingers determining the arc of the swinging motion and the location of fingers determining the location of the swinging motion.

6. Fire fighting turret, comprising:

(a) a nozzle apparatus, including a main body adapted to be mounted in a fixed position, an intermediate body mounted on the main body for swinging movement relative thereto, and a nozzle mounted on the intermediate for adjustment to a selected angle to the angle of the said swinging movement, (b) a source of pressure air, (c) an elevation pneumatic cylinder connected to the source to bring about the said adjustment, (d) a rotation pneumatic cylinder connected to the source to bring about the said swinging movement, (e) a pair of selector fingers pivotally mounted on a common pivot, each finger having a limit switch, and (f) a bracket movable in synchronization with the rotation cylinder to come into operative relationship alternately with the limit switchs on the selector fingers to cause oscillation of the intermediate body and the nozzle, the arc and direction of oscillation being selectable by corresponding adjustment of the fingers.

7. Fire fighting nozzle as recited in claim 6, wherein the limit switches are reed switches and the bracket carries a magnet that actuates a reed switch by moving into proximity thereto.

* * * * *